United States Patent [19]

Nett

[11] 4,153,044

[45] May 8, 1979

[54] BACKSHELF VENTILATING HOOD

[76] Inventor: Louis A. Nett, P.O. Box 199N, Rte. #1, Cambridge, Wis. 53523

[21] Appl. No.: 871,301

[22] Filed: Jan. 23, 1978

[51] Int. Cl.[2] ..... F24C 15/20; F23J 11/00

[52] U.S. Cl. ..... 126/299 D; 98/36; 55/DIG. 36

[58] Field of Search ..... 126/299 D; 55/DIG. 36; 98/36, 115 R, 115 LH

[56] References Cited

U.S. PATENT DOCUMENTS

| | | | |
|---|---|---|---|
| 3,978,777 | 9/1976 | Nett | 126/299 D |
| 4,043,319 | 8/1977 | Jensen | 126/299 D |
| 4,089,327 | 5/1978 | Welsh | 126/299 D |

*Primary Examiner*—Ronald C. Capossela
*Attorney, Agent, or Firm*—Andrus, Sceales, Starke & Sawall

[57] ABSTRACT

A low profile backshelf type hood having back, top, and side walls is either floor mounted or wall mounted to form a hood enclosure partially surrounding a source fo fumes or vapors. Outside untempered forced air is directed in through the top of the hood and up to the top front of the hood, where it is directed backwardly and downwardly through the enclosure as a narrow curtain at high velocity toward an exhaust opening. A filter is located within the opening and angularly oriented such that the high velocity air curtain engages the upper third of the filter and perpendicularly to the filter. Fumes arising upwardly pass into the exhaust opening along with the injected air, with the exhausted fumes and air then being drawn upwardly and out through an exhaust channel within the hood enclosure ductwork leading to the exhaust fan. Provision is also made for exhausting combustion fumes from gas fired equipment.

26 Claims, 5 Drawing Figures

BACKSHELF VENTILATING HOOD

BACKGROUND OF THE INVENTION

1. Field of the Invention

This invention pertains generally to the field of exhaust hoods, and particularly to the wall mounted and self-supporting type adapted to fit partially around a source of vapors or fumes.

2. Description of The Prior Art

It is often desired to fully ventilate the fumes arising from commercial kitchen and industrial appliances where ceiling mounted ventilating hoods and fans can not be used because of the height of the ceiling, or because the ventilation from a ceiling mounted hood is inadequate. In addition, ceiling mounted hoods will often produce unacceptable drafts across serving counters in open "display" cooking, and will similarly cause drafts through a pass-through type service window between the kitchen and dining areas. In such situations, ventilating hoods are commonly used which are wall mounted or self-supported and which form a partial enclosure about the appliance. Commonly known as backshelf or countertop hoods, the usual ventilating hood of this type has an exhaust opening at the back of the hood allowing communication with an exhaust chamber from which the exhaust gases are withdrawn by suction provided by a ventilating fan. A single exhaust duct generally leads from the top or back of the hood up to the roof where the exhaust fan is located. Substantial amounts of tempered air in the room in which the hood is located must be withdrawn by the fan in order to provide the necessary withdrawal of the fumes from the area directly underneath the top of the hood. This withdrawal of large amounts of tempered air is wasteful of energy as well as being obviously uneconomical. Moreover, because grease particles and vapors can arise to the inside top wall of the hood, frequent cleaning of the underside of the hood is required in order to prevent build up of grease and dirt in this area.

SUMMARY OF THE INVENTION

The backshelf hood of my invention may be self-supporting on a floor or supported on some other support means such as a wall in position to surround a stove, grill, or industrial appliance or area and which contains vapors to be removed such as grease particles that arise from the cooking or fume producing surfaces. The hood enclosure is generally defined by a top wall and a partially enclosing vertical wall which generally includes a back wall and opposite side walls, all of which may be supported off the floor by a plurality of support legs, or attached to a wall for support. Injected forced air under pressure may be directed through a supply duct to the top of the enclosure, and an exhaust duct mounted behind the supply duct leads from the top to the location of the exhaust fan. Provision is also made for separate exhaust of combination gases from gas fired equipment. Separate exhaust of combustion gases is desirable, since the heat expansion of the combustion gases and intermixed air would substantially increase the required exhaust volume flow rate if these gases were exhausted through the primary exhaust duct. The hot combustion gases also tend to heat up a grease filter when passing therethrough, which degrades the ability of the filter to condense grease from the exhaust fumes.

Air, preferably, from outside the building, is drawn in by an intake fan and forced under pressure through a supply duct to the top of the hood enclosure, and interior walls within the enclosure define an air supply channel which directs the incoming air to the front of the top wall. A deflector panel mounted at the front of the top wall redirects the flowing air backwardly and downwardly toward an exhaust opening in the back wall. The panel is preferably a smooth continuously curved member to produce a smooth deflection of the air to create an air curtain. The exhaust opening and a filter mounted therein are canted backward such that the flowing air strikes the filter at substantially a right angle to minimize vortexing at the filter. The exhaust opening communicates with interior walls defining an exhaust channel in the enclosure which directs the exhaust gases received from the opening to the top of the hood enclosure at a position directly behind that at which the intake air enters the enclosure. The exhaust gases are thereafter transmitted by conventional duct work to an exhaust fan mounted in the ceiling or in a wall. In an optimum and particularly unique structure, a throat plate is mounted in a position spaced away from the deflector panel to define an air injection slot therewith such that incoming forced air will be directed backwardly and downwardly out of the slot in a narrow high velocity stream. The high velocity stream of air provides an area of lower than ambient pressure by the venturi effect to capture vapors arising from the cooking surface and thereby help the exhaust fan draw vapors into the exhaust opening. The air injection slot preferably extends across substantially the length of the exhaust hood and provides a curtain of air substantially across the width of the top of the hood enclosure from the deflector panel to the back wall of the enclosure. This stream of air effectively prevents grease particles from accumulating on the inside upper surfaces of the hood enclosure and minimizes the frequency at which cleaning of these surfaces is required. More air is withdrawn from the exhaust channel by the external exhaust fan than is injected through the air injection slot, thus providing a net draft of air into the area of the hood enclosure. This air is preferably made up by a source of tempered secondary air injected into the room adjacent to the ventilating hood. This uniform flow of tempered air provides an air flow toward the ventilating hood which carries fume laden air into the hood and prevents dispersal of the fumes.

The walls defining the air supply channel are provided with insulation to prevent condensation on the outside surfaces of the hood because of the possible temperature differentials between the outside air and the ambient air surrounding the hood enclosure. The incoming untempered air is preferably baffled by a distribution plate which extends across the length of the air supply channel at a position therein beneath the intake position at which the outside untempered air enters from the supply ducts to the air supply channel. The distribution plate evens out the velocity of air flowing therethrough along substantially the entire length of the air supply channel.

The exhaust channel preferably extends below the position of the exhaust opening in the back wall and has a bottom pan with a drain opening therein to allow draining of accumulated grease within the exhaust channel. An additional combustion gas inlet opening may be formed along at least a portion of the bottom of the exhaust channel. The combustion gases rising in the exhaust channel from the opening are deflected by baffle plates which extend across the length of the exhaust channel. These baffle plates segregate the combustion gases from the fumes passing through the exhaust opening until all of the fumes and vapors have passed into the upper portion of the exhaust channel. The segregation of combustion gases from exhaust fumes prevent the hot combustion gases from warming the grease filter and degrading its ability to condense grease particles passing through the filter, and minimizes the undesired heating of these cooking vapors and interfering with the exhaust because of expansion.

The top wall of the hood enclosure can be located quite close to the fume surface which is being ventilated, thereby presenting a low profile for the overall hood structure and allowing overhead space to be used for other purposes or left unobstructed. The proximity of the hood enclosure to the fume surface allows the fumes to be ventilated with less withdrawal of room air than is required with ceiling mounted exhaust hoods, and avoids drafts across counter areas which would be present where a ceiling mounted canopy hood is used. My backshelf hood can thus be used in or below a pass through window or in open display cooking. The top surface of the hood enclosure itself may be used for storage, transfer of dishes, or installation of shelving or cabinetry.

Further objects, features, and advantages of my invention will be apparent from the following detailed description taken in conjunction with the accompanying drawings, showing preferred embodiments of a ventilating hood exemplifying the principles of my invention.

DESCRIPTION OF THE PREFERRED EMBODIMENTS

Figure 1:
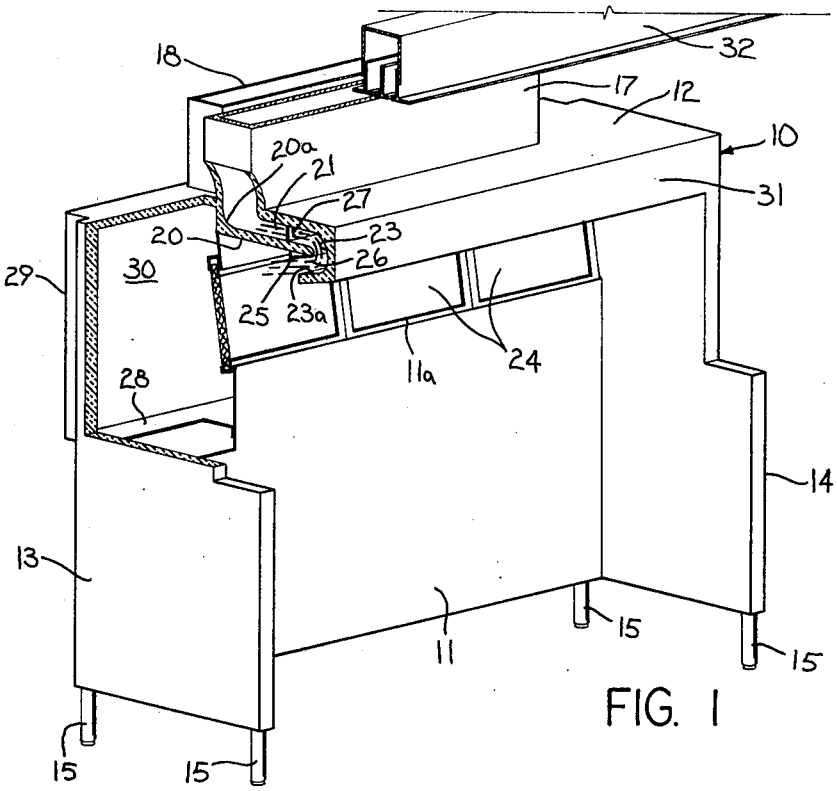
FIG. 1 is a partially broken away perspective view of my backshelf exhaust hood having a flat countertop.

With reference to the drawings, wherein like numerals refer to like parts in each of the several views, a first preferred embodiment of my ventilating hood having a flat countertop is shown generally at 10 in FIG. 1. The hood 10 has a hood enclosure formed by a back wall 11, a top wall 12 and a pair of side walls 13 and 14. Portions of the back wall 11 and the first side wall 13 have been shown broken away in FIG. 1 in order to better illustrate the internal structure of the hood enclosure. The entire hood 10 is adapted to be self-supportng on a floor by a plurality of support legs 15. The enclosure formed by the hood 10 is adapted to partially surround a grill or stove (shown in diagrammatically in phantom in FIG. 1), other similar kitchen device or any industrial fume producing equipment. The partial physical enclosure of the fume producing equipment aids in containing the fumes arising from the surface of the equipment, and allows the fumes to be efficiently exhausted with less withdrawal of room air than is required with other types of ventilating equipment such as ceiling mounted hoods.

Outside untempered air is drawn in by an air intake fan (not shown) and is delivered through an insulated supply duct 17 to an opening in the top wall 12 of the hood. Exhaust gases exit from an opening in the top wall preferably immediately behind the supply duct 17 and are drawn through exhaust duct work 18 to a wall or roof mounted exhaust fan (not shown).

An insulated upper panel 20 extending horizontally across the width of the hood enclosure is mounted in and below in spaced relation from the top wall 12 to form an air supply channel 21 in the space between the top wall and the upper panel. The back of the upper panel 20 has an upwardly curved portion **20*a* formed thereon which acts to smoothly deflect the downwardly moving incoming air into a horizontal direction toward the front of the top wall 12. The channel 20*a*** preferably extends laterally for the entire length of the hood, or at least for the area of the hood which is to be ventilated.

A curved deflector panel 23 is mounted at the front of the top wall to smoothly deflect the forwardly moving incoming air and redirect it backwardly and downwardly toward an exhaust opening **11*a* in the back wall 11 as an air curtain 23*a*. The deflector panel 23 is preferably formed without sharp perpendicular surfaces such as a rectangular member in order to maintain an essentially laminar flow in curtain. The deflector panel 23 is shown with a smooth continuous surface to produce optimum flow characteristic. The surface for example may be developed by a plurality of small flat surfaces or the like which produce an essentially progressive deflection of the air. For most kitchen applications where grease is to be extracted from the air being ventilated, a grease filter 24 will be interposed in the exhaust opening. The filter 24, and the orientation of the exhaust opening 11*a* are canted backwardly as shown, preferably at an angle of approximately 15°, such that the supply air flowing backwardly and downwardly will strike the grease filter at approximately a right angle. It is desirable that the air impact upon the grease filter at substantially a right angle in order to minimize vortexing at the filter and substantial loss of exhaust efficiency as a result. It is preferred that the air deflected by the deflector plate 23 move at a high velocity and in a narrow stream across the hood into the back wall opening 11*a*. To aid in defining a confining nozzle construction having a slot from which the flowing air exits and flows substantially laminar curtain 23*a*, a throat plate 25 is shown mmounted to the upper panel 20 along the front edge thereof to define an air injection slot between the throat plate 25 and a substantially straight deflector panel bottom portion 26 which is disposed generally parallel to the throat plate 25. A slot width in the range of approximately 1 to 2 inches has been found to provide the desired narrow high speed curtain of air, which may be typically in the range of 1600 to 2300 feet per minute. The high speed air curtain captures fumes arising from the surface of equipment beneath and projects such fumes into the grease filter and exhaust opening, and also provides additional vacuum draw by virtue of the venturi type effect accompanying the high speed air flow. It is noted that because the top of the back shelf hood 10** may be located fairly close to the upper surface of the equipment that is producing fumes, less exhaust air volume is required than with ceiling suspended hoods which are a substantial distance from the fume generating surface. As shown in the partial cross section of FIG. 1, a perforated baffle plate 27 extends longitudinally across the entire air supply channel 21 from the upper panel 20 to the top wall 12. The perforated baffle plate acts to substantially equalize the velocity of air flow expelled from the air exit slot along the entire length of the hood enclosure.

A bottom panel 28 and back panel 29 are mounted to the hood enclosure in association with the backwall 11 to define an exhaust channel 30 which receives the exhaust air and fumes drawn through the exhaust opening 11*a*, and directs the exhaust gases upwardly to the opening in the top wall 12 which leads to the exhaust duct 18. The bottom panel 28 is preferably slanted slightly toward one end where a drain plug (not shown) can be provided to allow draining of any grease condensing within the exhaust channel.

The top wall 12, upper panel 20, and the space between the deflector panel 23 and a front face plate 31, are insulated with standard insulating materials that are non-flammable and non-toxic, so that these outside surfaces remain at substantially the temperature of the surrounding air so that moisture does not condense on the surfaces. It is noted that the air being transmitted through the air supply channel is brought in directly from the outside and is untempered, and thus may be substantially warmer or colder than the air within the kitchen. The portions of the side walls 13 and 14 which form the ends of the intake channel are also preferably insulated so as to prevent condensation of moisture on the outside surfaces of these structures also.

In order to aid in the proper withdrawal of fumes from the fume producing surface and to inhibit their spread into the surrounding area, it is desirable that tempered air be introduced into the room from a position in the ceiling spaced away from but proximate to the front of the hood closure. As shown in FIG. 1, this tempered air can be provided with a slot diffuser 32 which extends longitudinally across the front of the hood enclosure preferably being spaced approximately 2 to 3 feet from the front of the top wall 12 of the hood enclosure and directing of the air downwardly toward the lower end of the hood. For optimum performance, approximately 20% of the air exhausted through the exhaust opening will be provided by tempered air from the slot diffuser, with the other 80% being provided by the outside air injected in through the air injection slot of the hood. As indicated above, the exhaust gases are withdrawn from the exhaust channel within the hood by an exhaust fan (not shown) which is chosen to have a capacity sufficient to properly exhaust the volume of air being injected both through the outside air injection slot and the hood enclosure and through the slot diffuser mounted in the ceiling.

Figure 2:
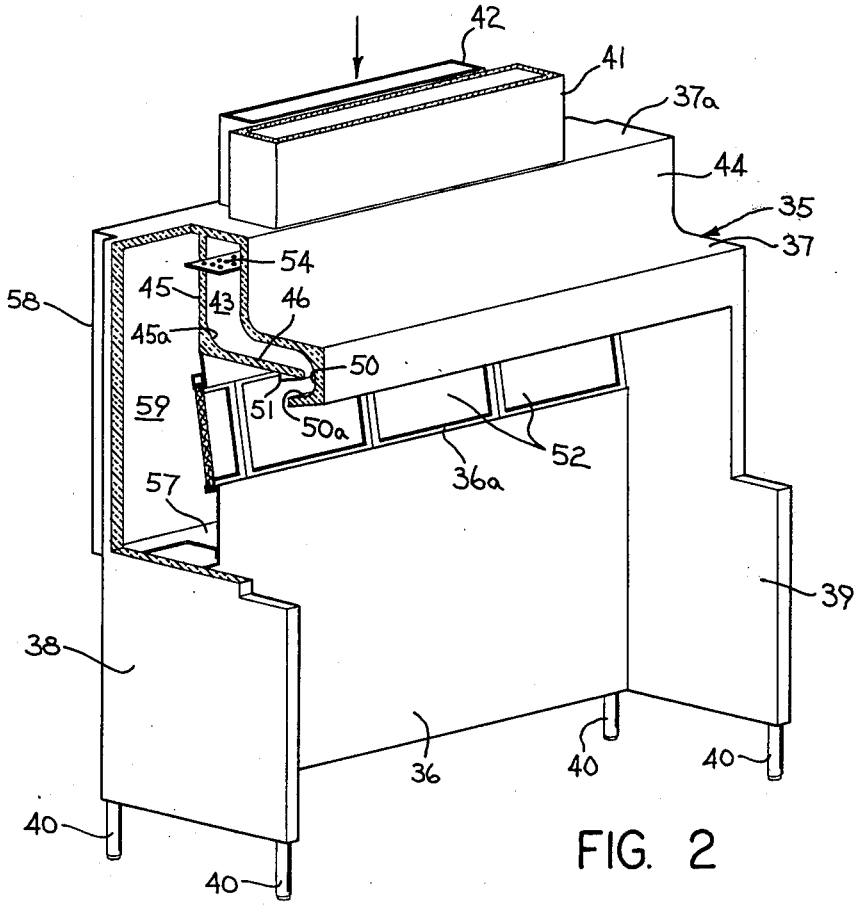
FIG. 2 is a partially broken away perspective view of another version of my backshelf hood which has portions of the supply and exhaust chambers extending upwardly from the countertop of the hood.

A modified version of my ventilating hood having an upwardly extending countertop is shown generally at 35 in FIG. 2. The hood 35 is similar to the basic hood shown in FIG. 1, having a back wall 36, partial top wall 37, and a pair of side walls 38 and 39. This hood is also adapted to be supported on the floor by a plurality of support legs 40, in position to partially surround a kitchen or industrial fume producing appliance.

Outside untempered air is delivered in from an intake fan (not shown) through an insulated supply duct 41, and the exhaust fumes are pulled upwardly and out to an exhaust fan (not shown) through an exhaust duct 42. The incoming supply air passes through a raised countertop portion 37*a* of the top wall of the hood and into the air supply channel 43 formed by an outer vertically disposed front panel 44 and an inner vertically disposed panel 45 which terminates at the bottom into a smoothly curved deflector portion 45*a* thereof which extends into a horizontally disposed insulated upper panel 46. The upper panel 46 is spaced below the top wall 37 to thereby form a portion of the air supply channel which directs the incoming supply air toward the front of the top wall. A smoothly curved deflector plate 50 is mounted to the front of the top wall and positioned to smoothly deflect the incoming supply air backwardly and downwardly toward an exhaust opening 36*a* in the back wall. A throat plate 51 is mounted to the front end of the upper panel in spaced relationship above and away from the straight extending portion 50*a* of the deflector panel to thereby form an air injection slot which directs the high speed incoming air in a narrow well defined stream toward the exhaust opening. A standard grease filter 52 is preferably interposed in the exhaust opening, and is canted back at an angle as shown in FIG. 2 such that the incoming air from the air injection slot will strike the grease fliter at approximately a right angle.

The upward extending portion of the incoming supply chamber which is formed between the two vertically disposed panels 44 and 45 allows a broad area over which the incoming air may defuse to or evenly distribute itself over a length of the exhaust hood enclosure. A perforated baffle plate 54 is mounted in the air supply channel 43 between the panels 44 and 45 and extending entirely across the length of the air supply channel. This perforated baffle plate again provides an impedence to the flow of air therethrough that tends to equalize the speed of air exiting the air injection slot at any position along the length of the hood enclosure.

A bottom panel 57 and a back panel 58 are mounted to the hood enclosure in association with the back wall 11 and inner panel 45 to define an exhaust channel 59 which receives the exhaust air and fumes drawn through the exhaust opening 36*a*. The exhaust gases received in the exhaust channel are directed upwardly to an opening in the upper countertop portion 37*a* of the top wall which leads to the exhaust duct 42. Again, the bottom panel 57 is preferably slanted slightly toward one end where a drain plug (not shown) can be provided to allow draining of grease, moisture or sediment which accumulates within the exhaust channel. The hood shown in FIG. 2 may also be utilized with a secondary air supply with a slot diffuser in the ceiling (not shown) which uniformly directs tempered air into the room at positions spaced a short distance away from the front of the hood enclosure.

Figure 3:
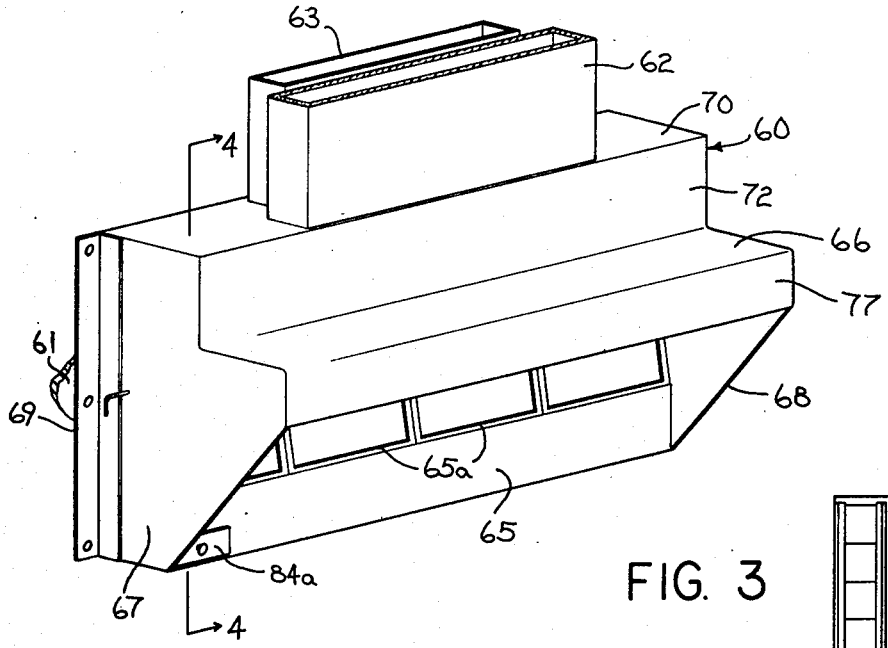
FIG. 3 is a perspective view of a wall mounted version of my backshelf hood.

Another version of my back shelf ventilating hood which is adapted for mounting on a wall is shown generally at 60 in FIG. 3. The hood 60 is shown in persective in FIG. 3 illustratively mounted to a portion of a wall shown at 61. The operation of the hood 60 is entirely analogous to that of the above described hood shown generally at 10 and 35, but differing in its structure due to the wall mounting of the hood.

Intake air under pressure is supplied from an air intake fan (not shown) through the exhaust hood through an air supply duct 62 exhaust air and gases are directed out of the hood through an exhaust duct 63 which leads to an exhaust fan (not shown).

The hood enclosure is defined by a back wall 65, a top wall 66 and a pair of side walls 67 and 68. The entire hood enclosure is preferably mounted to a wall above a stove or industrial appliance in proximity to the fume producing surface of the appliance. The enclosure may be attached to the wall by the brackets 69 shown illustratively in FIG. 3.

Incoming air received from the air supply duct 62 passes through an opening in an upper top shelf 70 which is above the level of the top wall 66. As best shown with reference to the cross-sectional view of FIG. 4, the incoming supply air from the air supply duct 62 enters an air supply channel 71 which directs the supply air to the front of the hood and then backwardly and downwardly toward an exhaust opening 65*a* in the back wall 65. The downward directed portion of the air supply channel is defined between an outer vertically disposed front panel 72 and an inner vertically disposed panel 73 which terminates at the bottom thereof into a smoothly curved deflector portion 73*a* which extends into a horizontally disposed insulated upper panel 74. The portion of the air supply channel 71 defined between the top wall 66 and the upper panel 74 directs the incoming air outwardly toward the front of the hood enclosure where it is deflected by a curved deflector plate 76 downwardly and backwardly toward the exhaust opening. The vertically disposed panel 72 and 73, the upper panel 66, and the area between the deflector plate 76 and a front face plate 77, are insulated to prevent condensation of moisture on the surfaces due to the temperature differential between the incoming supply air and the air in the room ambient to the hood.

A throat plate 78 is mounted to the front end of the upper panel in spaced relationship above and away from a straight extending portion 76*a* of the deflector panel to thereby form an air injection slot which directs the high speed incoming air in a narrow well defined stream toward the exhaust opening. Again, a standard grease filter 80 is preferably mounted in the exhaust opening, with the mounting provided by mounting brackets 81 at the bottom of the filter and 82 mounted to the back wall at the top of the filter. Mounted below the filter 80 is a grease trough 83 which catches grease dripping from the bottom of the grease filter and which has a slated bottom portion 83*a* which declines downwardly toward one end of the trough. An opening is provided at the end of the trough (not shown) to allow the draining of the grease from the trough into a removable grease pan 84 which can be removed by an operator by pulling off the face panel 84*a* from the front of the hood.

Exhaust air being drawn through the filter 80 passes into an exhaust channel 85 which is defined between the inner vertical panel 73 and a back panel 86, which directs the exhaust air upwardly through an opening in the upper top shelf 70 and the to the exhaust duct 63. The bottom of the exhaust channel is defined by a bottom panel 87, which directs the exhaust air upwardly through an opening in the upper top shelf 70 and then to the exhaust duct 63. The bottom of the exhaust channel is defined by a bottom panel 87, which also serves to capture any grease or dirt which is not deposited in the grease pan 84.

Figure 4:
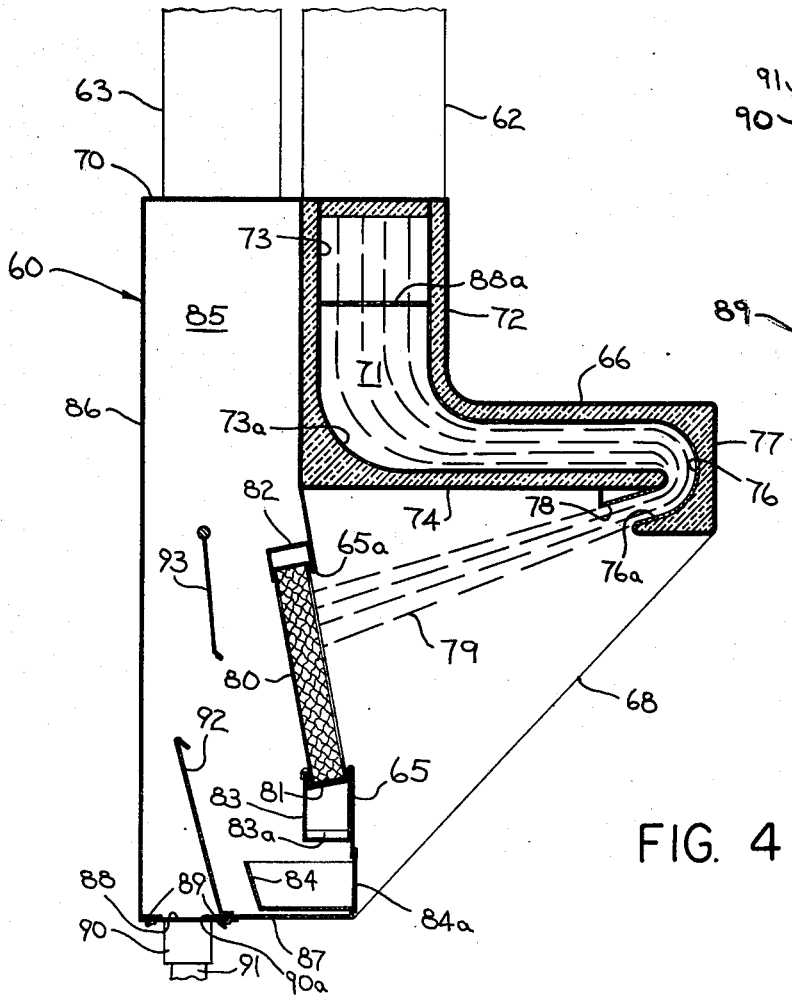
FIG. 4 is a cross section of the wall mounted backshelf hood of FIG. 3 taken along the line 4—4 of FIG. 3.

As shown in FIG. 4, the slot defined between the straight portion 76*a* of the deflector plate and the throat plate 78 directs incoming air in a narrow high velocity stream 79 toward the filter 80. Because the incoming air must be directed downwardly as well as backwardly, I have found that it is highly desirable to cant the filter 80 backwardly to an angle such that the incoming supply air strikes the filter at an angle approximately perpendicular to the filter. It is also preferred that the incoming supply air be directed toward the top one-third of the filter so as to allow substantial area within the bottom two-thirds of the filter for exhaust gases to pass into the filter without interference from the fast moving air stream. These considerations are also generally applicable to the versions of my exhaust hood shown in FIGS. 1 and 2 which are both illustratively shown with the filters canted backwardly.

The desirablity of the supply air striking the filter at approximately a right angle is due to the minimization of vortexing that takes place at the filter under such a condition. If the very fast moving injected supply air were to strike the filter at angles substantially sharper than perpendicular, the result would be deflection of the supply air off of the filter which will tend to deflect away incoming fumes and greatly reduce the efficiency of exhaust through the filter.

Figure 5:
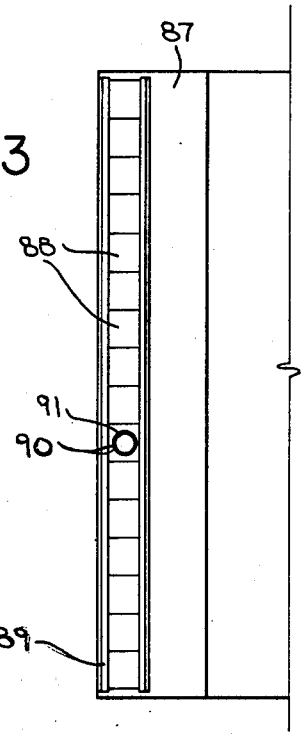
FIG. 5 is a bottom view of the wall mounted backshelf hood of FIG. 3.

In order to equalize the air flow velocity across the entire length of the exhaust hood, a perforated baffle plate 88 is interposed in the supply channel 71 so as to provide a uniform impedence to incoming supply air. Baffle plate 88*a* is similar to the baffle plate 54 of the upright top back shelf hood 35 that is shown in FIG. 2.

Where gas fired equipment is utilized, it is often desirable to be able to vent the combustion gases from an oven, for example, into the exhaust channel of the hood for ultimate exhaust to the outside atmosphere. In the hood 60 shown in FIG. 4, provision for the ducting of exhaust gases into the exhaust chamber is made by providing a slot like opening in the bottom panel 87 which extends across the length of the bottom of the hood. As best shown in FIG. 5, a plurality of cover panels 88 are slidably mounted to the bottom panel 87 by strip brackets 89 to slidably cover portions of the slot 90*a*. Collar 90 may be abutted up into the slot in position to receive an exhaust duct 91 from a gas oven, and the cover plates 88 may be slid together in abutment with the duct 90 to cover all portions of the opening 88 except where the duct 90 extends into the opening. Because hot combustion gases will be arising from the duct position, these hot gases may interfere with the air flow within the exhaust chamber and can potentially heat up the back of the hood 80 to the point where it no longer functions effectively to congeal and condense the grease fumes flowing through it. To minimize the effect of the hot gases arising within the exhaust channel 85, a first baffle panel 92 is mounted to the bottom panel 87 at its bottom and extends upwardly and across the entire length of the exhaust channel 85. As shown, the baffle panel 92 declines backwardly over the slot opening 90*a* so that it will direct rising hot exhaust gases toward the back panel 86 and away from the filter 80. A second adjustable baffle panel 93 extends across the length of the exhaust channel 85 and is mounted at its ends to the insides of the side walls 67 and 68. The second baffle panel 93 is mounted as shown slightly behind and at the upper portion of the filter 80 so as to prevent hot gases rising past the first baffle panel 92 from vortexing and swirling around back into contact with the filter. The positioning of the second baffle panel 93 is selected to regulate the pressure drop evenly across the face of the filter or exhaust opening and still provide very little interference with the flow of exhaust fumes and air passing through the filter, but effectively prevents any mixing of the exhaust gases with the incoming air below the top of the filter.

It is understood that my invention is not confined to the particular construction and arrangement of parts herein illustrated and described, but embodies all such modified forms thereof as come within the scope of the following claims. Generally, the creation of a relatively narrow or confined air stream or curtain which is a high velocity flow and which engages generally the upper third of a backwardly canted filter at substantially a right angle are significant, particularly for optimum functioning. The various other significant features and structures of the illustrated embodiments will be readily understood by those skilled in the art from the previous description.

Various modes of carrying out the invention are contemplated as being within the scope of the following claims, particularly pointing out and distinctly claiming the subject matter which is regarded as the invention.

I claim:

1. A ventilating hood comprising a hood enclosure having a top wall means and a partially enclosing side wall means arranged to form an enclosure having an opening in the sidewall means for access into the enclosure, an air supply channel means associated with said hood enclosure, said air supply channel means extending along the top wall means and receiving forced air and directing the air received to the front of said top wall means along a substantial portion of the length of said top wall; deflector means associated with said top wall for deflecting the air from said air supply channel at the front of said top wall means backwardly and downwardly into said enclosure toward said back wall as a thin curtain of air across the enclosure, exhaust channel means associated with said hood enclosure, said enclosing wall means has a back wall portion with a vertically extended exhaust opening therein positioned to receive the air curtain discharged from said deflector means, said exhaust channel directing air received from said exhaust opening to a discharge opening in said hood enclosure for exhaust to the atmosphere, and a fume filter interposed in said exhaust opening, said fume filter being canted backwardly at an angle from vertical with the upper end of the filter located backwardly of the lower end such that the air directed downwardly and backwardly from said deflector means strikes said filter approximately perpendicularly to the filter thereby to minimize vortexing of the supply air at the filter and provide efficient exhaust therethrough.

2. The ventilating hood of claim 1 wherein said air supply channel means and said exhaust channel means both include portions thereof which extend above said top wall along a substantial portion provided in said enclosure means and the top of the extending portions of each said channel being adapted to be connected to upwardly extending air supply duct and fume exhaust duct respectively.

3. The ventilating hood of claim 1 including a perforated baffle plate extending across said air supply channel at a position spaced away from the opening at which supply air enters the air supply channel, said baffle plate closing off the air supply channel and providing an impedence to air flow therein which substantially equalizes the velocity of air flow across the length of the air supply channel.

4. The ventilating hood of claim 1 wherein said deflector means comprises a curved deflector plate mounted to said top wall at the front thereof and essentially continuously curving backwardly toward said back wall and having a straight extending portion thereof which is directed at said fume filter and being parallel to said straight extending portion of said deflector plate to define a narrow air injection slot which directs the incoming supply air backwardly and downwardly toward said fume filter in a narrow high velocity stream curtain.

5. The ventilating hood of claim 4 wherein the spacing between said straight extending portion of said deflector plate and said throat plate is essentially in the range of 1 and 2 inches.

6. The ventilating hood of claim 4 wherein said supply air is directed against said filter at a position within the top one-third of the vertical height of the filter.

7. The ventilating hood of claim 1 wherein said supply air is directed against said filter at a position within the top one-third of the vertical height of the filter.

8. The ventilating hood of claim 1 wherein the walls defining said air supply channel are provided with heat insulation to insulate said air supply channel from surrounding ambient air and thereby minimize condensation of moisture on the surfaces of these walls.

9. The ventilating hood of claim 1 including a grease trough mounted beneath said fume filters in position to collect grease and liquid dripping therefrom, said trough declining downwardly toward one end of said hood enclosure to provide drain-off of grease and moisture within said trough.

10. The ventilating hood of claim 9 wherein said exhaust channel has a horizontally disposed bottom panel defining the bottom of said exhaust channel, and wherein said bottom panel has a slot therein extending substantially the length of said exhaust channel, an exhaust gas duct means connected to said slot, and including a plurality of cover panels slidably mounted to said bottom panel in position to selectively cover and close off said slot and to abutt against said combustion gas exhaust duct to seal off all portions of the slot except at the position where the exhaust gas duct extends into the slot.

11. The ventilating hood of claim 10 including a baffle panel mounted to said bottom panel forwardly of said slot opening and extending across said exhaust channel, said bottom panel extending backwardly and upwardly to direct exhaust gases received from said slot backwardly in said exhaust channel and away from said fume filter.

12. The ventilating hood of claim 11 further including a second baffle mounted intermediate the top and bottom of said exhaust channel and extending there across, said second baffle panel being disposed to extend from its bottom upwardly and backwardly and in position to prevent exhaust gases arising past said first baffle panel from vortexing and curling back into contact with said fume filter.

13. A ventilating hood apparatus for exhausting of the environment over a horizontal work area, comprising an exhaust passageway means having means for mounting adjacent the rear portion of the work area and including a generally vertically disposed exhaust opening means, a top wall unit having means for mounting in overlying vertically spaced relation to the work area and extending forwardly of said exhaust passageway means, said top wall unit including a plurality of spaced walls defining a supply passageway extending from the rear portion of the front portion of the top wall unit, air supply means coupled to said supply passageway and adapted to establish a high velocity air flow therethrough, a reverse deflector means connected to the forward end of the passageway and including an essentially continuously curved passageway extending forwardly and downwardly and then rearwardly and downwardly and defining a discharge passageway to redirect the fluid and define a relatively narrow air curtain extending over the work area and into said exhaust opening means, a filter means overlying said opening means, said filter means being angularly oriented with the top portion located rearwardly of the lower portion, and said discharge end of the passageway means being angularly oriented to direct said air stream to engage said filter means essentially perpendicular to the screen.

14. The ventilating apparatus of claim 13 wherein said supply passageway includes parallel spaced horizontal walls.

15. The ventilating apparatus of claim 13 wherein said reverse deflector means includes a generally U-shaped portion having one end connected to and forming a part of said supply passageway and a second end defining said discharge passageway, said U-shaped portion constituting an essentially continuous smooth deflection of the supplied fluid for developing a laminar stream flowing across the work area to the exhaust opening means.

16. A ventilating hood comprising a hood enclosure having a top wall means and a partially enclosing side wall means arranged to form an enclosure having an opening in the side wall means for access into the enclosure, an air supply channel means associated with said hood enclosure, said air supply channel means extending above the top wall means and receiving and directing the air received to the front of said top wall means along a substantial portion of the length of said top wall, said supply channel including means to distribute the air throughout the channel to establish a similar flow to the front of said top wall, an essentially smooth and curved nozzle means associated with said top wall for essential continuous deflection of air from said air supply channel at the front of said top wall backwardly and downwardly toward said back wall and discharging a narrow air stream which extends backwardly and downwardly at a high velocity, an exhaust channel means associated with said hood enclosure, and wherein said enclosing wall means has a back wall with a vertically extended front wall with an exhaust opening in the front wall positioned in alignment with the path of said air stream directly to receive said air stream discharged from said deflector means, said exhaust channel directing air received from said exhaust opening to a discharge opening in said hood enclosure for exhausting said air and fumes.

17. The ventilating hood of claim 16, including a fume filter interposed in said exhaust opening, and wherein said fume filter is canted backwardly at an angle from vertical with upper end of the filter spaced backwardly from the lower end of the filter such that the air directed downwardly and backwardly from said deflector means strikes said filter approximately perpendicularly to the filter thereby to minimize the vortexing of the supply air at the filter and provide efficient exhaust therethrough.

18. The ventilating hood of claim 17, wherein said air supply channel and said exhaust channel both include portions thereof which extend above said top wall along a substantial portion, and the top of the extending portions of each said channel adapted to be connected to upwardly extending air supply duct and fume exhaust ducts respectively.

19. The ventilating hood of claim 16, wherein said exhaust channel has a portion thereof extending below said exhaust opening and having a bottom pan, said bottom pan converging downwardly toward a drain opening therein.

20. The ventilating hood of claim 16 including a perforated baffle plate extending across said air supply channel at a position spaced away from the opening at which supply air enters the air supply channel, said baffle plate closing off the air supply channel and providing an impedence to air flow therein which substantially equalizes the velocity of air flow across the length of the air supply channel.

21. The ventilating hood of claim 16 wherein said exhaust channel has a horizontally disposed bottom panel defining the bottom of said exhaust channel, and wherein said bottom panel has a slot therein extending substantially the length of said exhaust channel, and including a plurality of cover panels slidably mounted to said bottom panel in position to selectively cover and close off said slot and to abutt against a combustion gas exhaust duct to seal off all portions of the slot except at the position where the exhaust gas duct extends into the slot.

22. The ventilating hood of claim 21 including a baffle panel mounted to said bottom panel forwardly of said slot opening and extending across said exhaust channel, said bottom panel extending backwardly and upwardly to direct exhaust gases received from said slot backwardly in said exhaust channel and away from said fume filters.

23. The ventilating hood of claim 22 further including a second baffle mounted intermediate the top and bottom of said exhaust channel and extending there across, said second baffle panel being disposed to extend from its bottom upwardly and backwardly and in position to prevent exhaust gases arising past said first baffle panel from vortexing and curling back into contact with said fume filters.

24. A ventilating hood comprising a hood enclosure means having a backwall portion and opposite side wall portions and a top wall portion forming an enclosure open at the front thereof; an air supply channel means receiving forced air and directing the air to the front of said top wall means along a substantial portion of the length of said top wall means; deflector means associated with said top wall means for deflecting air from said air supply channel means at the front of said top wall means backwardly and downwardly toward said back wall portion; an exhaust channel means having an exhaust chamber with a vertical exhaust opening in the back wall portion and positioned to receive air discharged from said deflector means and exhausting the received air from the area of the enclosure means, a combustion gas duct means connected to the bottom wall means by a bottom wall opening extending substantially for the width of the exhaust chamber and including a plurality of cover panels slidably mounted to said bottom panel in position to selectively cover and close off said slot and to abutt against said combustion gas exhaust duct to seal off all portions of the slot except at the position where the exhaust gas duct means extends into the slot.

25. The ventilating hood of claim 24 wherein a baffle panel mounted to said bottom panel forwardly of said slot opening and extending across said exhaust channel, said bottom panel extending backwardly and upwardly to direct exhaust gases received from said slot backwardly in said exhaust channel and away from said fume filters.

26. The ventilating hood of claim 25 wherein further including a second baffle mounted intermediate the top and bottom of said exhaust channel and extending there across, said second baffle panel being disposed to extend from its bottom upwardly and backwardly and in position to prevent exhaust gases arising past said first baffle panel from vortexing and curling back into contact with said fume filters.

* * * * *